United States Patent [19]

Möllerström

[11] Patent Number: 4,483,111

[45] Date of Patent: Nov. 20, 1984

[54] SCREEN OR LOUVRE STRUCTURE

[75] Inventor: Sten Möllerström, Vinslöv, Sweden

[73] Assignee: Alusol Dasolas AB, Gothenburg, Sweden

[21] Appl. No.: 426,088

[22] Filed: Sep. 28, 1982

[30] Foreign Application Priority Data

Sep. 28, 1981 [DK] Denmark ..... 4279/81

[51] Int. Cl.[3] ..... E04B 1/34

[52] U.S. Cl. ..... 52/74; 52/710; 52/473

[58] Field of Search ..... 52/473, 74, 710, 73; 40/16.2, 16.4, 16, 17, 18, 10 R

[56] References Cited

FOREIGN PATENT DOCUMENTS 1348741 3/1974 United Kingdom ..... 52/74

OTHER PUBLICATIONS

Berden and Co., A.B. Brochure, (Sweden), *Solovent Solskarmar typ* 42 och 47, Jan., 1973, pp. 1-4.

*Primary Examiner*—John E. Murtagh
*Assistant Examiner*—Kathryn Ford
*Attorney, Agent, or Firm*—Antonelli, Terry & Wands

[57] ABSTRACT

A screen structure which includes a number of interspaced carrier members and at least one long screen member having a base flange which is adapted to be mounted in a holding track through a tilting insertion motion. At least one edge portion of the base flange and a remaining space is left behind the edge portion and the respective holding track. Profiled filler members are endwise insertable into at least a partial length of the remaining space for stabilizing the base flange relative to the carrier member. At least one end of each filler member has a longitudinally projecting end portion forming a resiliently bendable finger of a reduced cross section such that, during an insertion, the finger is bendable away from an adjacent wall portion of the carrier member. The outer end portion of the finger is provided with a lateral protrusion which is adapted to snap outwardly behind an end or recess edge thereof by the end of the insertion. Corresponding protrusions are located on the filler member so as to abut an oppositely oriented end or recess edge of the carrier member by a further insertion displacement of the filler member.

4 Claims, 7 Drawing Figures

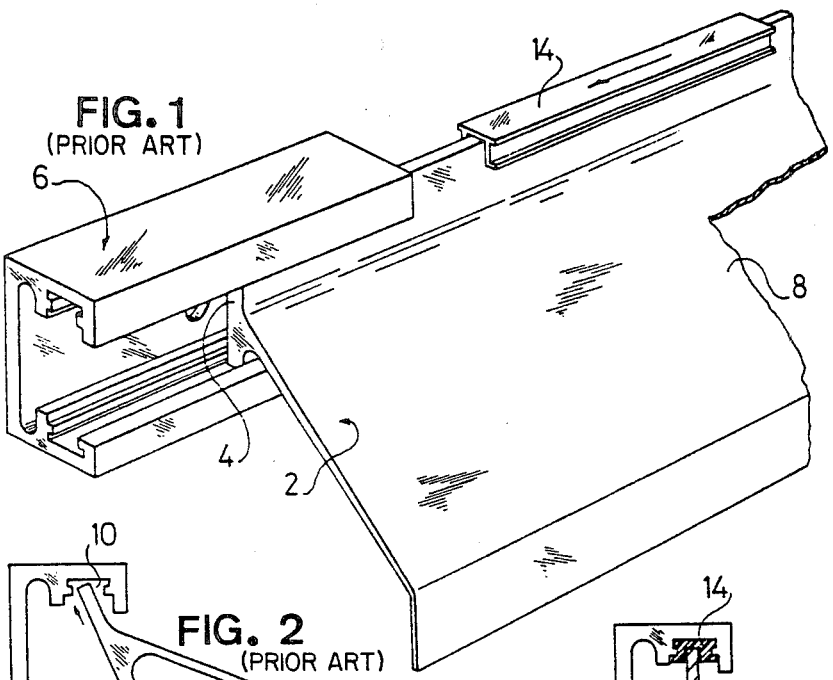
FIG. 1
(PRIOR ART)
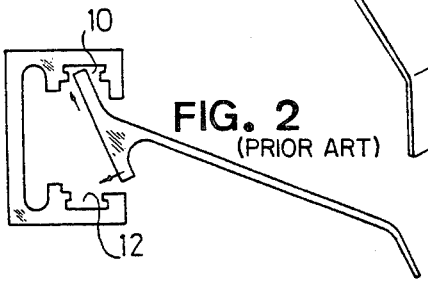
FIG. 2
(PRIOR ART)
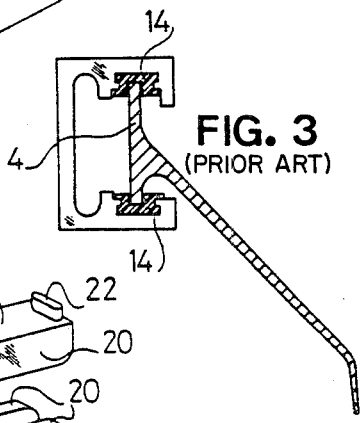
FIG. 3
(PRIOR ART)
FIG. 4
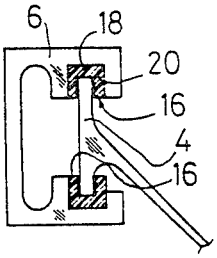
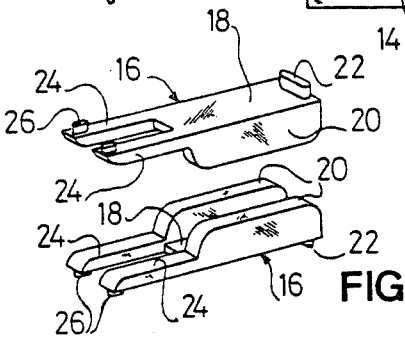
FIG. 5
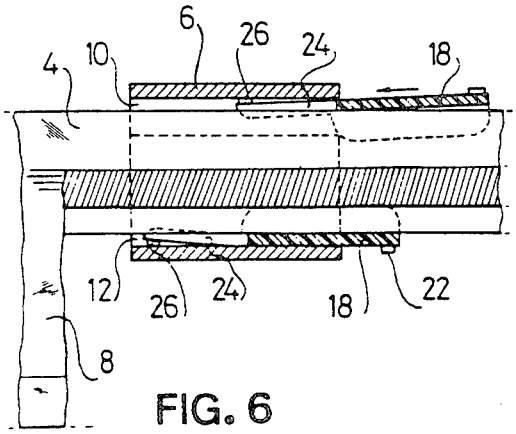
FIG. 6
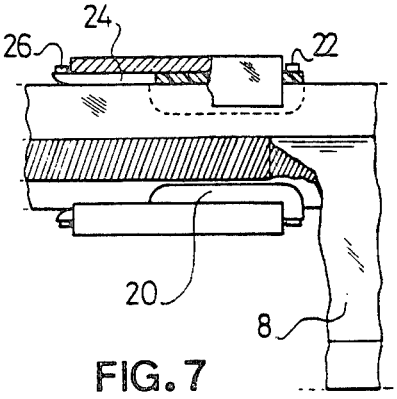
FIG. 7

SCREEN OR LOUVRE STRUCTURE

The present invention relates to a screen or louvre structure of the type specified in the introductory clause of claim 1. Typically such a structure comprises a number of parallel screen members which are mounted in a corresponding number of rows of fixed carrier members, these members normally being short C-profiled blocks as cut from an extruded aluminium beam. The screen members themselves, including their base flange, are also extrusions, and they are mounted so as to overlap each other when seen from a certain angle or space, e.g. for sun shading purposes.

To facilitate a more detailed description of the background of the invention reference will already here be made to the accompanying drawing, in which FIGS. 1–3 show a typical known arrangement of the mounting of a screen member.

The screen member is designated 2 and consists of a strip formed base flange 4, which is received in a carrier member 6, and a screen plate portion 8 projecting from the flange 4 at an oblique angle therewith. The carrier member 6 is a connector member adapted to receive the respective ends of two adjacent screen members, of which only one is shown. Normally the screen members are long enough to have to be supported at more places than just endwise, and for such support is normally used carrier members 6 of reduced length.

The screen members 2 could well be mounted in carrier members 6 by a simple lengthwise introduction of the base flange 4 in the C-profiled members 6, but such a mounting would be inconvenient because of the usual considerable length of the screen members. The base flange and the carrier elements, therefore, are designed so as to enable the mounting to take place by tilting the base flange into the carrier members without any length wise displacement of the screen members, and it is shown in FIG. 2 how this tilting mounting is effected in well known manner, viz. by one (the upper) edge of the base flange 4 under an oblique angle being put up into a holding groove 10 in the carrier member 6, whereafter the opposite edge of the base flange is swung into a position adjacent an opposed holding groove 12. The base flange will be locked against a direct pulling out, when it is thereafter displaced towards the latter groove.

In practice, however, it is unavoidable that the base flange will be mounted rather loosely in the carrier member, and it is desirable to obtain a mounting which is rigid enough to prevent the screen member from clattering in the wind or from unintentional loosening from its engagement with the carrier member. It is well known, therefore, to stabilize the mounting by means of suitable filler parts, which are brought to fill out the remaining space between the flange edges and the cooperating grooves of the carrier member. Such filler parts are shown in FIGS. 1 and 3 as consisting of profiled filler members 14, which are from outside pushed axially into the said spaces. The filler members 14 normally consist of pieces cut off from an extruded plastic profile, and as particularly shown in FIG. 3 it is achievable hereby that the base flange 4 as tilted into the carrier members will be non-tiltably fastened to the carrier members.

The screen members in a system of the discussed type will normally require fastening in a considerable number of carrier members, and for the mounting work, therefore, it will be very important that the filler members 14 be mountable in a reasonably simple manner, i.e. without the need of any high insertion force. For this reason the filler members are normally designed so as to fit in the said spaces with light sliding fit, whereby they are easy to introduce into the joints and still produce a practically non-tiltable fastening of the base flange 4 in the carrier members 6.

Practice has shown, however, that the ease of insertability of the filler members is nevertheless connected with a quite significant drawback, viz. that the filler members may in time work themselves out of the joints by the influence of the thermally conditioned longitudinal movements of the screen members 2. Therefore, large efforts have been made for providing an anchoring of the filler members 14 to the carrier members 6 with the use of transverse holding screws or of local deformations of the carrier members. The resulting mounting work, however, has hereby been made difficult to such a degree it was certainly no longer as simple as desirable.

The invention more specifically relates to a screen or louvre system as here discussed, and it is the purpose of the invention to provide a simple solution to the discussed mounting problem.

According to the invention this is obtainable when the system is designed as stated in the characterizing clause of claim 1.

The invention is based on the recognition that for the required stabilization of the mounting it is not necessary that the entire of the said remaining space be filled by the filler member, if it is only filled out along a substantial part of its length, and it is hereby possible to use a filler member, which shows such a reduced cross section along an end portion thereof that this end portion, which constitutes the leading end by the insertion movement, may be bent in a resilient manner to enable the said lateral protrusions to be moved through the space and thereafter snap out behind the rear edge of the carrier member by the end of the invention movement.

Thus, in its mounted condition the filler member will engage the carrier member also by way of radial protrusions which will positively prevent any axial relative movements of these elements, i.e. the said thermally conditioned motions of the screen member will not be able to cause the filler member to get displaced away from the carrier member. This firm holding action is not based on any hard frictional engagement, which would incur high mounting force requirements for the filler members, but on a simple mechanical snap locking action, which is achievable by virtue of a low insertion force.

Advantageously the end portion of the filler member may be constituted by two parallelly spaced projecting fingers operable to be bent along opposite parallel surface portions of the base flange.

Hereafter the invention will be described in more detail with further reference to the drawing, in which FIGS. 1, 2, and 3 refer to prior art.

FIG. 4 is a sectional view of a structure according to the invention as comparable to the section shown in FIG. 3, FIG. 5 is a perspective view of an upper and a lower filler member according to the invention, FIG. 6 is a length sectional view of a carrier member, illustrating the mounting of the filler member according to FIG. 5, and FIG. 7 is a corresponding length sectional view showing the filling members in their finally mounted condition.

The carrier member profile 6 shown in FIG. 4 corresponds to the profile already described above, although the tracks or grooves 10 are designed without any inwardly protruding rib portions as in FIGS. 1–3; however, this is not necessarily any important or required difference from the known system. The filler members, now designated 16, are shown in more detail in FIG. 5. They each consist of a die cast plastic member having a base plate portion 18, which along a partial length thereof, is provided with parallel edge flanges 20, which project to one side and show rounded end corners, while at one end the plate portion 18 has an abutment knob 22 projecting to the opposite side. At its other end the base plate portion 18 is forwardly prolonged in a pair of mutually spaced fingers 24 having partly rounded outer ends and endwise provided with knobs 26 projecting in the same direction as the knob 22 at the opposite end of the base plate 18. The distance between the fingers 24 of each element 16 corresponds to or is slightly larger than the thickness of the base flange 4 of the screen member 2, and the thickness of the fingers in the same direction is suitably small to allow the fingers to be received in the space between the sides of the base flange 4 and the sides of the grooves 10 and 12 of the carrier member 6, while the thicknesses of the base plate portion 18 and the edge flanges 20 correspond to a filling out of the cross sectional space between the base flange edge portions and the grooves 10, 12, see FIG. 4.

Thus, the filler members shown in FIG. 5 may be inserted into the discussed space in the manner illustrated in FIG. 6 by first introducing the fingers 24, as shown topwise in FIG. 6, until the leading edge of the base plate 18 is clamped between the edge of the base flange 4 and the bottom of the groove 10. Due to the projecting knobs 26 on the fingers 24 the filler member will by this initial insertion assume an oblique position, in which the base plate 18 is not further introduceable into the discussed space.

However, since the fingers 24 are resiliently bendable, it will nevertheless be possible, as shown bottomwise of FIG. 6, to further introduce the filler member 16, as the base plate 18 will hereby be guided to lie parallel with the adjacent surfaces of the bottom wall of the respective groove 10 or 12 and the respective outer edge of the base flange 4. Hereby the knobs 26 on the fingers 24 will be resiliently held against the groove bottom until the filler member reaches its final position as shown in FIG. 7, in which the knobs 26 will be forced outwardly by a resilient stretchening out of the fingers 24. The filler member will thereafter be locked against axial displacement both forwardly and rearwardly, since outwardly protruding stop knobs 22 and 26 will be located just outside both ends of the carrier member. A demounting, however, may of course be effected by depressing the outer ends of the fingers 24 and return pushing the filler member.

In FIGS. 6 and 7 the carrier member is shown as a short member for carrying an area of a through-goring screen member, but the carrier member may be of increased length to constitute a joining member as according to FIG. 1, whereby the filler members 16 should be correspondingly longer. However, the said fingers 24 need not be of increased length (see lower portion of FIG. 6), because their resilient bending out and their subsequent straightening out will be independent of the length of the remaining part of the filler member. Correspondingly, for the filling action itself it is non-essential that the filler member along a partial length thereof, viz. along the fingers 24, does not entirely fill out the relevant space; when only another partial length of the filler member shows the cross section as illustrated in FIG. 4, the screen member 2 will nevertheless be held as desired in or by the carrier member, and the filler members could even be provided with fingers 22 at both opposite ends, whereby the filler members would be insertable optionally with either end as the leading end.

If desired, each filler member could be provided with only a single finger 24, and the knobs 22 and/or 26 may alternatively be laterally projecting, whereby of course the fingers 24 should be pendable into the space between the outer edge of the base flange 4 and the bottom of the respective groove 10 or 12.

When produced by die casting the filler members 16 will be as cheap as the known filler members (14), as they are used in large amounts, and the advantages of the invention, therefore, are achievable without increased costs.

The invention will comprise the use of a single filler member for each carrier member 6, the design being such that one edge of the base flange 4 already by its insertion or its tilting into the carrier member will be stabilized sufficiently without any subsequent insertion of a filler member.

Moreover the invention will comprise the use of filler members 16 of a length smaller than that of the carrier members 6, when the latter are provided with suitable holes or internal recesses for receiving the knobs 22 and/or 26.

What I claim is:

1. A screen structure comprising a plurality of interspaced carrier members and one or more longish screen members having a base flange, which is mountable in holding track means in said carrier members by a tilting insertion motion, whereby at least along one edge portion of the base flange a remaining space is left between this edge portion and the respective holding track, and further comprising filler members profiled so as to be endwise insertable into at least a partial length of said remaining space for stabilizing the base flange relative each carrier member, characterized in that each filler member at least at one end has a lengthwise projecting end portion which constitutes a resiliently bendable finger of reduced cross section, such that during the insertion the finger is bendable away from an adjacent wall portion of the carrier member, the outer end portion of the finger being provided with a lateral protrusion directed towards that wall portion and operable to snap outwardly behind an end or recess edge thereof by the end of the insertion, corresponding protrusion means being located on the filler member so as to abut an oppositely oriented end or recess edge of the carrier member by an attempted further insertion displacement of the filler member.

2. A screen structure according to claim 1, in which the protrusion of the finger cooperates with a first virtual end surface of the carrier member, while a corresponding protrusion cooperates with the other virtual end surface thereof, the filler member being longer than the carrier member.

3. A screen structure according to claim 2, in which the body portion of the filler member is provided with one or more projecting fingers at one end only, the protrusion cooperating with said other virtual carrier member end being located laterally on said body portion adjacent the other end thereof.

4. A screen structure according to claim 1,2, or 3, in which the filler member has two parallelly spaced projecting fingers operable to be bent along opposite parallel surface portions of said base flange.

* * * * *